United States Patent [19]

Theurer

[11] Patent Number: 4,813,488

[45] Date of Patent: Mar. 21, 1989

[54] BALLAST CLEANING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 13,710

[22] Filed: Feb. 12, 1987

[30] Foreign Application Priority Data

Apr. 2, 1986 [EP] European Pat. Off. ..... 86890087.9

[51] Int. Cl.[4] ..... E01B 27/00

[52] U.S. Cl. ..... 171/16

[58] Field of Search ..... 171/16; 37/104, 105, 37/106, 107; 104/2–4, 7 A, 7 R

[56] References Cited

U.S. PATENT DOCUMENTS

| | | | |
|---|---|---|---|
| 2,142,208 | 1/1939 | Protzeller | 171/16 |
| 3,685,589 | 8/1972 | Plasser et al. | 171/16 |
| 3,872,929 | 3/1975 | Theurer et al. | 171/16 |
| 3,900,392 | 8/1975 | Speno et al. | 209/241 |
| 4,245,703 | 1/1981 | Theurer et al. | 171/16 |

FOREIGN PATENT DOCUMENTS

| | | |
|---|---|---|
| 3324926 | 1/1985 | Fed. Rep. of Germany . |
| 2198442 | 3/1974 | France . |
| 8400232 | 1/1984 | Netherlands . |
| 651870 | 10/1985 | Switzerland . |
| 2151676 | 7/1985 | United Kingdom . |

*Primary Examiner*—Robert E. Garrett
*Assistant Examiner*—Therese M. Newholm
*Attorney, Agent, or Firm*—Kurt Kelman

[57] ABSTRACT

A ballast cleaning machine for excavating ballast supporting a track and for cleaning the excavated ballast, comprises a ballast screening installation mounted on the machine frame and arranged to receive the excavated ballast from the discharge end of a ballast excavating and conveying chain, and to clean the received ballast by separating waste therefrom, the screening installation comprising two screening units each of which comprises a set of a plurality of superposed screens extending obliquely with respect to the track in the direction of elongation of the machine, the sets of screens being arranged sequentially in, and symmetrically with respect to a vertical plane extending transversely to, this direction, and the obliquely extending screens ascending from a centrally located common outlet of the two sets of screens to two separate inlets for the excavated ballast, and independent vibrators for each set of screens for conveying the cleaned ballast on the screens in respective conveying directions from a respective one of the inlets to the common outlet.

11 Claims, 1 Drawing Sheet

BALLAST CLEANING MACHINE

The present invention relates to a ballast cleaning machine for excavating ballast supporting a track and for cleaning the excavated ballast, which comprises a machine frame, a ballast excavating and conveying chain mounted on the machine frame for excavating ballast and for conveying the excavated ballast to a discharge end, a ballast screening installation mounted on the machine frame and arranged to receive the excavated ballast from the discharge end of the ballast excavating and conveying chain, and to clean the received ballast by separating waste therefrom, the screening installation comprising two screening units each of which comprises a set of a plurality of superposed screens extending obliquely with respect to the track in the direction of elongation of the machine, the sets of screens being arranged sequentially in, and symmetrically with respect to a vertical plane extending transversely to, said direction, and independent vibrating means for each set of screens for conveying the cleaned ballast on the screens in respective conveying directions, a conveyor band means for conveying the excavated ballast from the discharge end of the ballast excavating and conveying chain to the two sets of screens, a conveyor band arrangement having an input for receiving the cleaned ballast from the screening installation and an output for redistributing the cleaned ballast, and a conveyor band for receiving the waste from the screening installation and removing the same.

Such a machine is disclosed in U.S. patent application Ser. No. 655,766, filed Oct. 1, 1984, which corresponds to UK patent application No. 2,151,676 A, published July 24, 1985. The mobile ballast cleaning machine comprises a first work vehicle on which a ballast excavating and conveying chain is mounted and a second work vehicle succeeding the same in the operating direction and carrying a screening installation receiving the excavated ballast. The screening installation comprises two sets of vibratory screens extending obliquely with respect to the track in the direction of elongation of the machine, the sets of screens being arranged sequentially in, and symmetrically with respect to a vertical plane extending transversely to, this direction and having a common inlet receiving the excavated ballast from the chain at a respective upper end of each set of screens, and the obliquely extending screens descending from the respective upper ends to two separate ballast discharges. The output of the conveyor band arrangement redistributes the cleaned ballast immediately behind the ballast excavating site in the operating direction and the conveyor band arrangement includes a cleaned ballast storage container on the first work vehicle, the container having a bottom formed by a conveyor band and lateral outlet openings for delivering ballast at the ends of respective track ties. While such a screening installation has a considerable capacity but its single inlet distributes the excavated ballast equally to both screening units, which may cause problems.

Swiss patent No. 651,870, granted Oct. 15, 1985, also discloses a ballast cleaning machine with two successive work vehicles. The ends of the forward work vehicle are supported by respective undercarriages on the track while the forward end of the rear work vehicle is pivotally supported on a rear end of the forward work vehicle and its rear end is supported by an undercarriage on the track. A vertically adjustable ballast excavating and conveying chain is mounted on the rear work vehicle and a ballast screening installation receiving the excavated ballast from the chain is mounted on the rear end of the forward work vehicle. The screening installation is comprised of two ballast screening units arranged sequentially in a common, obliquely extending plane. The outlet end of the forward ballast screening unit discharges the cleaned ballast to the inlet end of the rear ballast screening unit so that all of the cleaned ballast is discharged from the outlet of the rear unit. The output of the cleaned ballast redistributing conveyor band arrangement leads to a redistributing chute arrangement discharging the cleaned ballast in the range of the ballast excavating and conveying chain. The chute arrangement has a first outlet opening discharging the cleaned ballast on the excavated track bed and a further outlet opening in the range of the raised track and leading to a cleaned ballast redistributing conveyor band. This conveyor band is transversely pivotal about a forward end thereof and conveys cleaned ballast in a direction opposite to the operating direction of the machine to a site immediately ahead of the last undercarriage of the ballast cleaning machine at both shoulders of the track. A pivotal cleaned ballast distributing element is arranged along the redistributing conveyor band to enable a desired amount of cleaned ballast to be directed to a site immediately behind the ballast excavating and conveying chain while another portion of the cleaned ballast is discharged by the transversely pivotal conveyor band on the track, depending on the position of this element. When the machine is stopped, the entire cleaned ballast is directed to the pivotal conveyor band. A waste conveyor band removes waste from the screening installation. The screening capacity of this machine is only a little greater than that of conventional ballast cleaning machines with a single ballast screening unit since the entire cleaned ballast flows through both sequentially arranged units. Furthermore, a relatively complex control is required to prevent at least a portion of the cleaned ballast coming from the screening installation from being conveyed when the ballast excavating and conveying chain is stopped. Another portion of the cleaned ballast is at any rate unevenly discharged in the excavated track bed.

U.S. Pat. No. 3,900,392, dated Aug. 19, 1975, discloses a mobile ballast cleaning machine with a ballast excavating apparatus mounted on a first work vehicle and a ballast screening installation mounted on a succeeding, second work vehicle. The screening installation is very large and comprises eight screening units arranged in pairs in successive transversely extending planes, the pairs of screening units being in V-formation. The screening units of each pair have respective inlets substantially along respective sides of the second work vehicle for receiving the excavated ballast from a conveyor band equipped with a ballast flow deflector device for laterally discharging the excavated ballast from the conveyor band to the respective inlets. The cleaned ballast is discharged to a common outlet between the screening units of each pair and a cleaned ballast redistributing conveyor band is arranged below the common outlets of the pairs of screening units to convey the cleaned ballast to a ballast discharge chute immediately preceding the screening installation. Such a screening installation is very large and correspondingly expensive, its complex structure requiring frequent repairs, in addition to which the cleaning paths of the transversely extending screening units are very short because of the predetermined width of the machine, which greatly reduces the cleaning capacity of the machine.

Finally, U.S. Pat. No. 4,245,703, dated Jan. 20, 1981, discloses a mobile ballast cleaning machine with a ballast screening installation arranged immediately behind the ballast excavating and conveying chain, a power-operated closure gate being mounted over the outlet of the screening installation to enable the outlet to be closed and the screening installation to be used as a storage container for the cleaned ballast in case of a sudden stoppage of the machine. This avoids the unwanted accumulation of cleaned ballast on the excavated track.

It is the primary object of this invention to improve a ballast cleaning machine of the first-described type so that its capacity is increased while it is better adaptable to differing ballast conditions along the track.

The above and other objects are accomplished in such a machine according to the invention with a screening installation wherein the obliquely extending screens of the two screening units ascend from a centrally located common outlet of the two sets of screens to two separate inlets for the excavated ballast, the independent vibrating means for each set of screens conveying the cleaned ballast on the screens in respective conveying directions from a respective one of the inlets to the common outlet, and the conveyor band means conveying the excavated ballast from the discharge end of the ballast excavating and conveying chain to the inlets of the two sets of screens.

This arrangement of the two independent ballast screening units provides a common cleaned ballast outlet of substantially doubled cross section for discharge of the cleaned ballast from the screening installation. Furthermore, since the common outlet is centrally positioned, the cleaned ballast redistributing conveyor band arrangement receiving the cleaned ballast from the screening installation needs to extend only under half the length of the installation, rather than under the entire length thereof. On the other hand, the provision of two separate inlets spaced from each other dependably prevents jamming of ballast because of excessive amounts of excavated ballast fed to the screening installation since the conveyed excavated ballast is divided before it is fed to the installation. This is also advantageous because the flow velocity of the ballast is particularly low when the ballast impacts the screens and, therefore, initial jamming of the ballast as it enters the screening installation tends to reduce the screening effect and correspondingly the screening capacity. Furthermore, since the two screening units are independent of each other, they may be used together at full capacity or one of the units may be used at full capacity and the other one at reduced capacity, depending on the amount of excavated ballast coming from the ballast excavating and conveying chain. If little ballast is excavated, only one of the screening units may be operated.

The above and other objects, advantages and features of the present invention will become more apparent from the following detailed description of certain now preferred embodiments thereof, taken in conjunction with the generally schematic drawing wherein FIG. 1 is a side elevational view of a ballast cleaning machine for excavating ballast supporting a track, for cleaning the excavated ballast and for redistributing the cleaned ballast;

Figure 1:
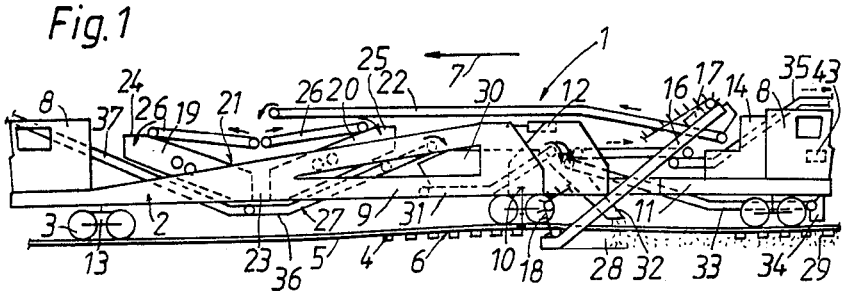
Figure 2:
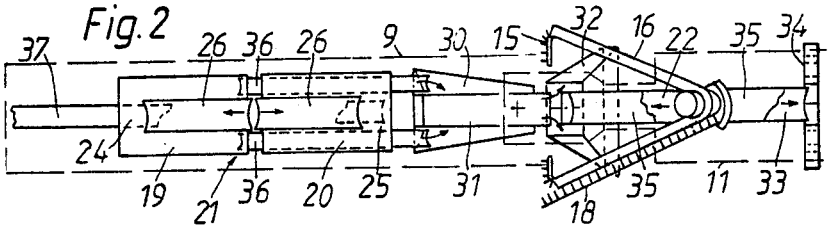
FIG. 2 is a simplified top view of the ballast cleaning machine of FIG. 1.

Referring now to the drawing and first to FIGS. 1 and 2, there is shown ballast cleaning machine 1 for excavating ballast supporting track 6 consisting of rails 5 fastened to ties 4 and for cleaning the excavated ballast. The machine comprises machine frame 2 supported on undercarriages 3 running on track 6 for moving machine 1 in an operating direction indicated by arrow 7. Operator's cabs 8 are mounted at opposite ends of machine frame 2 which is comprised of forward machine frame part 9 and rear machine frame part 11 linked to the forward machine frame part by pivot 10. A cylinder-piston drive 12 interconnects the forward and rear machine frame parts above pivot 10 for spreading the two machine frame parts apart about the pivot which extends transversely to the track. Central power plant 14 provides power to drive 13 and the operating tools of the machine. Ballast excavating and conveying chain 16 is vertically and laterally adjustably mounted on rear machine frame part 11 and comprises an endless chain driven by drive 17 for conveying the excavated ballast upwards in an obliquely inclined, longitudinal guide member to a discharge end. The endless chain has a transverse section extending below track 6 for excavating the ballast. The ballast excavating and conveying capacity is increased by mounting auxiliary chain 18 adjacent the longitudinal guide members of endless excavating and conveying chain 16, endless auxiliary chain 18 being rotatable in a vertical plane adjacent the longitudinal guide members of chain 16 for moving a portion of the excavated ballast upwards.

Ballast screening installation 21 is mounted on forward machine frame part 9 and is arranged to receive the excavated ballast from the discharge end of ballast excavating and conveying chain 16, and to clean the received ballast by separating waste therefrom. The screening installation comprises two screening units 19, 20 each of which comprises a set of a plurality of superposed screens 38 extending obliquely with respect to track 6 in the direction of elongation of machine 1, the sets of screens being arranged sequentially in, and symmetrically with respect to a vertical plane extending transversely to, this direction. The obliquely extending screens ascend from centrally located common outlet 23 of the two sets of screens to two separate inlets 24, 25 for the excavated ballast. Independent vibrating means 39 for each set of screens conveys the cleaned ballast on the screens in respective conveying directions from a respective inlet 24, 25 to common outlet 23.

Conveyor band means 22, 26 conveys the excavated ballast from the discharge end of ballast excavating and conveying chain 16 to inlets 24, 25 of the two sets of screens. This conveyor band means comprises trough-shaped conveyor band 22 driven by drive 46 and having an input end receiving the excavated ballast from the discharge end of the ballast excavating and conveying chain and output end 45 for conveying the excavated ballast in a conveying direction, indicated by a small arrow, from the input end to the output end, and a respective trough-shaped feeding conveyor band 26 associated with each screening unit 19, 20, each feeding conveyor band having an input end receiving the excavated ballast from the output end of trough-shaped conveyor band 22 and an output end feeding the excavated ballast to a respective one of separate inlets 24, 25. Drive 44 for each feeding conveyor band 26 conveys the excavated ballast thereon in a conveying direction, indicated by small arrows, opposite to the conveying direction of the cleaned ballast on screens 38 of the associated screening unit. Feeding conveyor bands 26 are arranged above the associated screening units, the input ends of the feeding conveyor bands are arranged centrally between the two screening units and the output end of conveyor band 22 is arranged above the input ends of feeding conveyor bands 26.

With this arrangement of respective feeding conveyor bands 26 associated with each screening unit, the excavated ballast may be conveyed to the respective screening unit inlets in a direction opposite to the ballast conveying direction in each screening unit, independently of the ballast conveying direction on conveyor band 22. This produces a high impact force of the ballast on the screen, causing clumps of encrusted ballast to be broken up into smaller pieces and a large amount of the waste to be removed from the ballast pieces as they drop with a high impact onto the screen. This relatively simple structural feature, therefore, additionally enhances the screening capacity of the machine. The particular arrangement of conveyor band means 22, 26 in relation to screening units 19, 20 enables the total length thereof to be decreased while providing feeding conveyor bands of the same structure and length. This assures the impact force of the conveyed ballast on the screens of the two screening units to be the same and equal amounts of excavated ballast to be conveyed by the feeding conveyor bands.

Machine 1 further comprises conveyor band arrangement 27 having an input for receiving the cleaned ballast from common outlet 23 of screening installation 21 and output 32 for redistributing the cleaned ballast. Conveyor band 37 receives the waste from, the screening installation and removes the same.

In the illustrated embodiment, intermediate storage container 30 is arranged between the input end of conveyor band arrangement 27 and the output thereof for receiving and temporarily storing excess cleaned ballast. The intermediate storage container is part of the conveyor band arrangement and comprises side walls and a bottom constituted by independently driven conveyor band 31. Illustrated conveyor band arrangement 27 comprises two parallel cleaned ballast collecting conveyor bands 36, 36 arranged below outlet 23 of screening installation 21 and extending in the conveying direction for receiving the cleaned ballast from the screening installation, and driven conveyor band 31. The cleaned ballast collecting conveyor bands have respective outputs above intermediate storage container 30 for delivering the cleaned ballast thereto, and conveyor band 37 for receiving the waste from the screening installation is arranged between the two ballast collecting conveyor bands 36, 36, suitable guide baffles (now shown) at the bottom of the screening units respectively guiding the cleaned ballast onto conveyor bands 36 and the waste onto conveyor band 37. This provides a space-saving and symmetrical conveyance of the cleaned ballast as well as the waste from screening installation.

Independently driven conveyor band 31 leads to a first cleaned ballast discharge site 28 immediately being the excavating site for discharging cleaned ballast on the excavated track bed, and the conveyor band arrangement further comprises another cleaned ballast redistributing conveyor band 33 mounted on the machine frame and having another output 29 rearwardly of the first cleaned ballast discharge site 28 for selectively redistributing cleaned ballast in the cribs at the other output at the rear end of the machine frame. Ballast collecting conveyor bands 36, waste receiving and removing conveyor band 37 and cleaned ballast redistributing conveyor bands 27, 31 and 33 are preferably trough-shaped. The output at first cleaned ballast discharge site 28 is comprised of cleaned ballast redistributing chute 32 mounted on machine frame 2 and having three outlet openings for discharging cleaned ballast in a central region betwen track rails 5 and at the respective ends of track ties 4. An adjustable ballast flow deflector is mounted at the input end of cleaned ballast redistributing conveyor band 33 enabling desired amounts of cleaned ballast to be directed selectively into chute 32 and/or to conveyor band 33 for feeding selected amounts of the cleaned ballast to output 29 which is comprised of chute 34 discharging the cleaned ballast into the cribs. Any excess cleaned ballast may be removed by a further conveyor band arrangement 35 mounted longitudinally displaceably on the machine frame above conveyor band 33 for selectively receiving excess cleaned ballast upon longitudinal displacement of the further conveyor band arrangement towards conveyor band 31 and for conveying the excess cleaned ballast to a freight train following machine 1 for transporting the excess cleaned ballast.

The arrangement of the intermediate cleaned ballast storage container enables the cleaned ballast to be stored temporarily in its flow path from the screening installation to the respective outputs of the cleaned ballast redistributing conveyor band arrangement, thus providing an effective buffer for the varying amounts of cleaned ballast coming from the screening installation and assuring an even redistribution of the cleaned ballast, regardless of these amounts. Furthermore, any amount of cleaned ballast coming from the screening installation after a sudden stop of the machine can be stored in the container rather than being wasted in an unwanted redistribution. The cleaned ballast is effectively stored in container 30 or conveyed therefrom for redistribution simply by stopping or driving container bottom conveyor band 31. The extension of cleaned ballast redistributing conveyor band arrangement 27 to the rear end of the machine by additional cleaned ballast redistributing conveyor band 33 and excess cleaned ballast conveyor band arrangement 35 enables the machine to be used selectively for redistributing cleaned ballast in the cribs and/or for removing excess cleaned ballast, thus further enhancing the efficiency of the machine and adapting it to prevailing ballast conditions.

Figure 3:
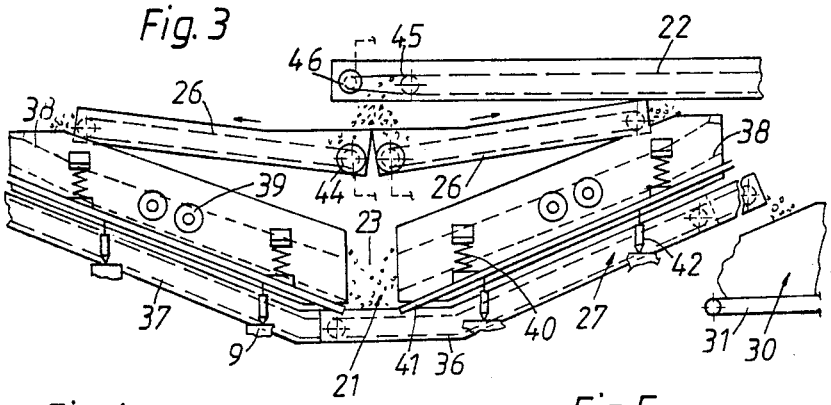
FIG. 3 is an enlarged side elevational view showing the screening installation of the machine in more detail.

As best shown in FIG. 3, each screening unit 19, 20 comprises a set of two superposed screens 38 arranged in parallel, ascending planes extending obliquely to a horizontal plane and each screening unit has its own vibrating drive 39. Each drive is constituted by rotatable flyweights imparting linear oscillations to the screening unit which is supported on springs 40 mounting the screening unit on carrier frame 41. The carrier frames are mounted on machine frame 2 for pivoting about a central axis extending in the direction of the elongation of the machine and can be pivoted about this axis by power drives 42 linking the carrier frames to forward machine frame part 9. This enables the screening units to be pivoted during the ballast cleaning operation in superelevated track sections so that screens 38 will the super elevation of the track remain horizontal to assure proper screening.

Control 43 is connected to drive 17 of ballast excavating and conveying chain 16 and vibrating means 39 of screening units 19, 20, the control being arranged for automatically reducing the vibrating frequency of the sets of screens below that required to convey the cleaned ballast thereon to common outlet 23 in response to the de-activation of the chain drive. This assures that, upon a sudden halt of the machine and a concurrent interruption of ballast excavation, the ballast that has been fed into the screening units remains stored therein because the vibrating frequency of the screens is insufficient to convey the ballast thereon to the common outlet. Maintaining the screens at a low vibrating frequency enables them to be rapidly restored to a high vibrating frequency with a relatively low power input when operations are resumed and the full screening capacity is desired.

Figure 4:
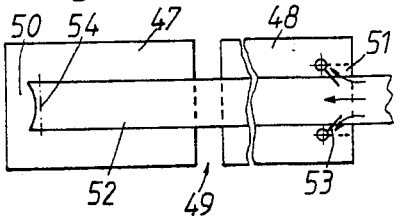
FIG. 4 is a fragmentary top view showing another embodiment of a structural detail of the screening installation.

FIG. 4 shows another embodiment of the conveyor band means for conveying the excavated ballast from the discharge end of the ballast excavating and conveying chain to the inlets of the two sets of screens. This conveyor band means comprises conveyor band 52 having an input end (not shown) receiving the excavated ballast from the discharge end of ballast excavating and conveying chain 16 and output end 54 for conveying the excavated ballast in a conveying direction, indicated by a straight arrow, from the input to the output end. The conveyor band extends above the two inlets 50, 51 of screening units 47, 48 of ballast screening installation 49 and inlet 51 is closer to the ballast excavating and conveying chain discharge end while other inlet 50 is remote from this discharge end. Output 54 of conveyor band 52 is arranged above remote inlet 50 for feeding excavated ballast thereto. Adjustable ballast flow deflector means 53 is arranged above closer inlet 51 for selectively feeding excavated ballast thereto. The illustrated ballast flow deflector means comprises two flag-like deflectors pivotal about vertical axes for selectively directing the flow of the conveyed excavated ballast to inlet 51 or to output end 54. When the deflectors are in the position shown in broken lines, the entire excavated ballast will flow into screening unit 47. This arrangement enables the screening units to be supplied in a simple manner with any desired portion of the excavated ballast, or none at all.

Figure 5:
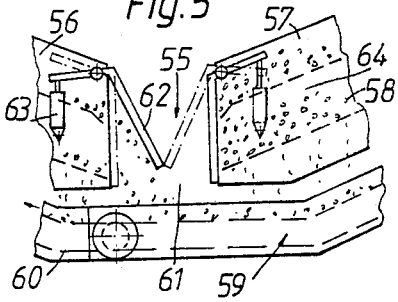
FIG. 5 is a fragmentary side elevational view showing another embodiment of another structural detail of the screening installation.

FIG. 5 illustrates another embodiment of a screening installation 55. In this installation, screening unit 56 comprises adjustable gate 62 adjacent common outlet 61 and actuatable between the illustrated open position when cleaned ballast 58 is delivered to the common outlet and a closed position wherein cleaned ballast 58 is temporarily stored in the screening unit. As shown in chain-dotted lines, screening unit 57 may be equipped with a like gate. The cleaned ballast falls from common outlet 61 onto cleaned ballast redistributing conveyor band arrangement 59 while the waste is removed by waste conveying and removing conveyor band 60. The illustrated gate is a closure element 62 pivotal about a transverse axis by pivoting drive 63 between the open and closed positions. When gate 62 is in the closed position, the screening unit is converted into a temporary storage container 64 for the cleaned ballast. This enables one of the screening units to be used at full capacity while the other screening unit is used for storing cleaned ballast until such a time as not enough cleaned ballast is produced to provide a sufficient amount of cleaned ballast for redistribution to the track bed. At that time, the gate is opened to deliver the stored cleaned ballast to common outlet 61.

The operation of the illustrated ballast cleaning machine will now be described in detail.

At the beginning of the ballast cleaning operation, transverse section 15 of endless ballast excavating and conveying chain 16 is disposed under track 6, machine 1 is advanced continuously in the operating direction indicated by arrow 7 and drive 17 is actuated to rotate the endless chain for excavating the ballast supporting the track and to convey the excavated ballast upwardly to conveyor band 22 which conveys the excavated ballast forwardly to foward machine frame part 9 where the excavated ballast is thrown onto feeding conveyor bands 26 centrally between screening units 19, 20 of ballast screening installation 21. The feeding conveyor bands convey the excavated ballast to respective inlets 24, 25 of the associated screening units in a direction opposite to the direction of ballast flow on the screens in units 19, 20, causing the ballast to hit the screens with a high impact force which divides any encrusted clumps into smaller pieces and shakes a major portion of the waste off the ballast. The vibratory motion of the downwardly inclined screens 38 causes the cleaned ballast to be conveyed towards common outlet 23 on the screens while simultaneously separating waste which falls through the screens to subtending conveyor band 37 removing the waste forwardly to be deposited, for example, in freight cars coupled to the front end of the machine or on the shoulders of the track. Cleaned ballast collecting conveyors 36, 36 subtend common screening installation outlet 23 and receive the cleaned ballast discharged therefrom and convey it to intermediate storage container 30 whence independently driven conveyor band 31 conveys the cleaned ballast to chute 32 for redistribution on the excavated track bed immediately behind the excavating site, where a first layer of cleaned ballast is laid up to the underside of track ties 4 for support thereof. Depending on the position of the ballast flow deflector at the input end of additional cleaned ballast redistributing conveyor band 33, a portion of the cleaned ballast may be directed to cleaned ballast redistributing chute 34 at the rear end of the machine. This cleaned ballast portion forms a second layer in the cribs for providing a complete ballast bed for track 6.

If too much cleaned ballast comes from screening installation 21, conveyor band arrangement 35 is longitudinally displaced towards the output end of conveyor band 31 to receive an excess of the cleaned ballast and to convey the excess cleaned ballast to a succeeding freight train.

If the advance of ballast cleaning machine 1 along track 6 is suddenly halted, independently driven conveyor band 31 is stopped so that the cleaned ballast discharged by feeding conveyor bands 36 into intermediate storage container 30 is stored therein, rather than being conveyed therefrom, thus avoiding an unwanted accumulation of cleaned ballast discharged from chutes 32 and 34. As soon as the advance of the machine is resumed, conveyor band 31 is driven again, possibly at an initially low speed.

If a reduced amount of ballast is excavated, for example in a track section where the ballast bed is shallow, the speed of drive 46 is increased to increase the conveying speed of conveyor band 22. This changes the discharge curve of the excavated ballast at output 45 so that all of the conveyed ballast will be thrown onto forward feeding conveyor band 26 to feed excavated ballast only to screening unit 19. To save energy, rear screening unit 20 and its associated feeding conveyor band 26 may then be de-activated. Depending on the conveying speed of conveyor band 22, variations in the respective amounts of excavated ballast fed to the two independent screening units may be achieved. It will be advantageous to change the oscillating frequency of the screening units in response to the amount of excavated ballast fed thereto for cleaning.

Best results with respect to maintenance, operational dependability and conveying capacity will be obtained with endless trough-shaped conveyor bands made of fabric-reinforced rubber and trained over rotatable rollers. The trough shape of the conveyor bands assures that no ballast or waste overflows the lateral edges of the conveyor bands even along lengthy conveyor paths and spills over machine parts or operating tools.

What is claimed is:

1. A ballast cleaning machine for excavating ballast supporting a track and for cleaning the excavated ballast, comprising (a) a machine frame, (b) a ballast excavating and conveying chain mounted on the machine frame for excavating ballast and for conveying the excavated ballast to a discharge end, (c) a ballast screening installation mounted on the machine frame and arranged to receive the excavated ballast from the discharge end of the ballast excavating and conveying chain, and to clean the received ballast by separating waste therefrom, the screening installation comprising (1) two screening units each of which comprises a set of a plurality of superposed screens extending obliquely with respect to the track in the direction of elongation of the machine, the sets of screens being arranged sequentially in, and symmetrically with respect to a vertical plane extending transversely to, said direction, and the obliquely extending screens ascending from a centrally located common outlet of the two sets of screens to two separate inlets for the excavated ballast, and (2) independent vibrating means for each set of screens for conveying the cleaned ballast on the screens in respective conveying directions from a respective one of the inlets to the common outlet, (d) a conveyor band means for conveying the excavated ballast from the discharge end of the ballast excavating and conveying chain to the inlets of the two sets of screens, (e) a conveyor band arrangement having an input for receiving the cleaned ballast from the common outlet of the screening installation and an output for redistributing the cleaned ballast, and (f) a conveyor band for receiving the waste from the screening installation and removing the same.

2. The ballast cleaning machine of claim 1, wherein the conveyor band means comprises a trough-shaped conveyor band having an input end receiving the excavated ballast from the discharge end of the ballast excavating and conveying chain and an output end for conveying the excavated ballast in a conveying direction from the input to the output end, a respective trough-shaped feeding conveyor band associated with each screening unit, each feeding conveyor band having an input end receiving the excavated ballast from the output end of the trough-shaped conveyor band and an output end feeding the excavated ballast to a respective one of the separate inlets, and a drive for each feeding conveyor band for conveying the excavated ballast thereon in a conveying direction opposite to the conveying direction of the cleaned ballast on the screens of the associated screening unit.

3. The ballast cleaning machine of claim 2, wherein the feeding conveyor bands are arranged above the associated screening units, the input ends of the feeding conveyor bands are arranged centrally between the two screening units and the output end of the conveyor band is arranged above the input ends of the feeding conveyor bands.

4. The ballast cleaning machine of claim 1, wherein the conveyor band means comprises a conveyor band having an input end receiving the excavated ballast from the discharge end of the ballast excavating and conveying chain and an output end for conveying the excavated ballast in a conveying direction from the input to the output end, the conveyor band extending above the two inlets of the screening units and one of the inlets being closer to the ballast excavating and conveying chain discharge end while the other inlet is remote from said discharge end, the output end of the conveyor band being arranged above the remote inlet for feeding excavated ballast thereto, and further comprising an adjustable ballast flow deflector means arranged above the closer inlet for selectively feeding excavated ballast thereto.

5. The ballast cleaning machine of claim 1, further comprising an intermediate storage container arranged between the input of the conveyor band arrangement and the output thereof for receiving and temporarily storing excess cleaned ballast.

6. The ballast cleaning machine of claim 5, wherein the intermediate storage container is part of the conveyor band arrangement and comprises side walls and a bottom constituted by an independently driven conveyor band.

7. The ballast cleaning machine of claim 5, wherein the conveyor band arrangement comprises two parallel cleaned ballast collecting conveyor bands arranged below the screening installation and extending in said direction for receiving the cleaned ballast from the screening installation, the ballast collecting conveyor bands having respective outputs above the intermediate storage container for delivering the cleaned ballast thereto, and the conveyor band for receiving the waste from the screening installation and removing the same is arranged between the two ballast collecting conveyor bands.

8. The ballast cleaning machine of claim 7, wherein the conveyor band arrangement further comprises another cleaned ballast redistributing conveyor band mounted on the machine frame and having another output rearwardly of the first-named output of the conveyor band arrangement for selectively redistributing cleaned ballast at the other output.

9. The ballast cleaning machine of claim 8, wherein the ballast collecting conveyor bands, and waste receiving and removing conveyor band and the cleaned ballast redistributing conveyor bands are trough-shaped.

10. The ballast cleaning machine of claim 1, wherein at least one of the screening units comprises an adjustable gate adjacent the common outlet and actuatable between an open position wherein the cleaned ballast is delivered to the common outlet and a closed position wherein the cleaned ballast is temporarily stored in the screening unit.

11. A ballast cleaning machine for excavating ballast supporting a track and for cleaning the excavated ballast, comprising (a) a machine frame, (b) a ballast excavating and conveying chain mounted on the machine frame for excavating ballast and for conveying the excavated ballast to a discharge end, the ballast excavating and conveying chain comprising a drive, (c) a ballast screening installation mounted on the machine frame and arranged to receive the excavated ballast from the discharge end of the ballast excavating and conveying chain, and to clean the received ballast by separating waste therefrom, the screening installation comprising (1) two screening units each of which comprises a set of a plurality of superposed screens extending obliquely with respect to the track in the direction of elongation of the machine, the sets of screens being arranged sequentially in, and symmetrically with respect to a vertical plane extending transversely to, said direction, and the obliquely extending screens ascending from a centrally located common outlet of the two sets of screens to two separate inlets for the excavated ballast, and (2) independent vibrating means for each set of screens for conveying the cleaned ballast on the screens in respective conveying directions from a respective one of the inlets to the common outlet, (d) a control connected to the drive and to the vibrating means, the control automatically reducing the vibrating frequency of the sets of screens below that required to convey the cleaned ballast thereon to the common outlet in response to the de-activation of the chain drive, (e) a conveyor band means for conveying the excavated ballast from the discharge end of the ballast excavating and conveying chain to the inlets of the two sets of screens, (f) a conveyor band arrangement having an input for receiving the cleaned ballast from the common outlet of the screening installation and an output for redistributing the cleaned ballast, and (g) a conveyor band for receiving the waste from the screening installation and removing the same.

* * * * *